US009314059B2

(12) United States Patent
Kanayama

(10) Patent No.: US 9,314,059 B2
(45) Date of Patent: Apr. 19, 2016

(54) LAMINATE OF CLOTHS, CLOTHING, AND BEDDING

(75) Inventor: Yotaro Kanayama, Kobe (JP)

(73) Assignee: finetrack, Kobe-shi (JP)

( * ) Notice: Subject to any disclaimer, the term of this patent is extended or adjusted under 35 U.S.C. 154(b) by 303 days.

(21) Appl. No.: 13/617,492

(22) Filed: Sep. 14, 2012

(65) Prior Publication Data

US 2014/0004332 A1 Jan. 2, 2014

(30) Foreign Application Priority Data

Jun. 27, 2012 (JP) ..... 2012-144356
Aug. 29, 2012 (JP) ..... 2012-188880

(51) Int. Cl.
*B32B 3/26* (2006.01)
*A41D 31/02* (2006.01)
*A47G 9/02* (2006.01)

(52) U.S. Cl.
CPC ..... *A41D 31/02* (2013.01); *A41D 2400/10* (2013.01); *A47G 9/02* (2013.01); *Y10T 428/249953* (2015.04)

(58) Field of Classification Search
CPC ..... B32B 3/26; B32B 2311/005; A41D 1/00; A41D 31/02; A41D 2400/10; A47G 9/02; Y10T 428/249953
USPC ..... 442/244, 246, 255, 323, 326, 381
See application file for complete search history.

(56) References Cited

U.S. PATENT DOCUMENTS

| | | | | |
|---|---|---|---|---|
| 5,252,374 | A * | 10/1993 | Larsonneur | 428/77 |
| 5,865,824 | A * | 2/1999 | Chen et al. | 604/378 |
| 6,263,511 | B1 | 7/2001 | Moretti | |
| 6,423,165 | B1 | 7/2002 | Hishinuma | |
| 6,723,416 | B1 | 4/2004 | Groitzsch et al. | |
| 6,855,228 | B1 * | 2/2005 | Perini | 428/153 |
| 2001/0008821 | A1 | 7/2001 | Russell et al. | |
| 2003/0040242 | A1 * | 2/2003 | Pike et al. | 442/352 |
| 2005/0245164 | A1 * | 11/2005 | Aneja et al. | 442/381 |
| 2009/0155543 | A1 | 6/2009 | Fowler | |
| 2010/0058589 | A1 | 3/2010 | Mirtsch et al. | |
| 2010/0086730 | A1 | 4/2010 | Lo et al. | |

FOREIGN PATENT DOCUMENTS

| | | | |
|---|---|---|---|
| CN | 101610858 | A | 12/2009 |
| CN | 201959103 | U | 9/2011 |
| EP | 1997405 | A1 | 12/2008 |
| GB | 2411621 | A | 9/2005 |
| JP | S50-041706 | U | 8/1948 |

(Continued)

OTHER PUBLICATIONS

Notice of Reasons for Refusal issued to JP Application No. 2011-097241 mailed Jul. 9, 2014.

(Continued)

*Primary Examiner* — Jeremy R Pierce
(74) *Attorney, Agent, or Firm* — Knobbe Martens Olson & Bear LLP

(57) ABSTRACT

The laminate of cloths includes a first outer layer, a second layer, and an inner layer disposed between the first outer layer and the second outer layer. A layer thickness of the inner layer disposed between the first outer layer and the second outer layer is formed to be larger than a cloth thickness of the inner layer, and a space part is formed between the first outer layer and the second outer layer.

11 Claims, 10 Drawing Sheets

(56) References Cited

FOREIGN PATENT DOCUMENTS

| | | | |
|---|---|---|---|
| JP | S63-045655 | U | 3/1988 |
| JP | H04-064506 | U | 6/1992 |
| JP | H10-226907 | A | 8/1998 |
| JP | 2000-511595 | A | 9/2000 |
| JP | 2000-345465 | B1 | 12/2000 |
| JP | 2003-503607 | B1 | 1/2003 |
| JP | 2007-211387 | A | 8/2007 |
| JP | 2007-291552 | A | 11/2007 |
| JP | 2009-197376 | A | 9/2009 |
| JP | 2009-214518 | A | 9/2009 |
| JP | 2010-018941 | A | 1/2010 |
| WO | 99/05926 | A1 | 2/1999 |

OTHER PUBLICATIONS

Submission of Information issued to JP Application No. 2011-097241 mailed Jun. 10, 2014.
Search Report issued in corresponding European patent application No. 12183572.2.
Japanese Office Action mailed Apr. 22, 2014 in Japanese Patent Application No. 2012-188880.
Office Action dated Dec. 25, 2014 in corresponding Japanese Patent Application No. 2012-188880.
Office Action issued Aug. 31, 2015 in corresponding CN Application No. 201210337351.2.
Office Action issued Aug. 24, 2015 in corresponding JP application No. 2012-188880.

* cited by examiner

LAMINATE OF CLOTHS, CLOTHING, AND BEDDING

CROSS-REFERENCE TO RELATED APPLICATIONS

This application claims priority to Japanese Patent Application No. 2012-144356 filed on Jun. 27, 2012 and Japanese Patent Application No. 2012-188880 filed on Aug. 29, 2012, and the disclosure of which including the specification, the drawings, and the claims is hereby incorporated by reference in its entirety. Japanese Patent Application No. 2011-097241 is another prior foreign application for which priority is not claimed. The entire disclosure of this prior foreign application is also incorporated by reference in its entirety.

BACKGROUND OF THE INVENTION

1. Field of the Invention

The present invention relates to a laminate of cloths, and clothing and bedding using this laminate having a first outer layer on the superficial side, a second outer layer on the skin side, and an inner layer disposed between the first outer layer and the second outer layer.

2. Description of the Related Art

Heat-retaining clothing such as a belly-warmer tie, a heat-retaining jacket and a down vest containing padding in the inner layer are conventionally known (see JP-A-2007-211387).

Patent document: JP-A-2007-211387

SUMMARY OF THE INVENTION

However, the padding sometimes leans to one side or migrate under its own weight in the condition that it is sandwiched between the outer layers. For preventing this, the padding is quilted, and the cloth of the skin-side outer layer and the cloth of superficial-side outer layer are sewed together to prevent the padding from leaning to one side or migrating. When plenty of cotton is used from the view point of heat retention, the weight increases, and the whole clothing becomes bulky. Also, use of cotton limits the size in the folded state for storage. Also cotton requires a long drying time when it is once wet, and has difficulty in using in the rainy weather. While feather may be used in place of cotton, the problems of leaning to one side, migration under its own weight and leakage have not been dissolved, and there is still the problem of high cost. In this case, whole washing by a washing machine is not allowed, so that special care should be taken in handling.

The present invention has been devised in consideration of the above problems, and it is an object of the present invention to provide a laminate of cloths, and clothing and bedding using this laminate realizing light weight, compactness in the folded state, quick-drying property, heat retention, low cost, and freeness from maintenance.

For solving the above problem, the present invention provides a laminate of cloths, having a first outer layer, a second outer layer, and an inner layer disposed between the first outer layer and the second outer layer, and a layer thickness of the inner layer disposed between the first outer layer and the second outer layer is formed to be larger than a cloth thickness of the inner layer, and a space part is formed between the first outer layer and the second outer layer.

According to this configuration, since it is possible to desirable form the space part between the first outer layer and the second outer layer because the layer thickness of the inner layer is formed to be larger than the cloth thickness of the inner layer, it is possible to provide a laminate of cloths, realizing light weight, compactness in the folded state, quick-drying property, low cost, and freeness from maintenance.

As one embodiment of the present invention, clothing or bedding is configured to have a laminate of cloths. Clothing is not particularly limited, and examples thereof include a vest type, a short-sleeved type, a long-sleeved type, a breeches type, a trousers type, a headwear, gloves, socks, a balaclava, a shawl, a loincloth, a muffler and the like. In addition, the bedding is not particularly limited, and examples thereof include a sleeping bag, a comforter, a futon mattress, a pillow, a blanket and the like.

In the aforementioned invention, the cloth of the inner layer may be made of any thread material by any weaving or knitting without any particular limitation, and may undergo various finish treatments (for example, moisture permeable and waterproofing finish, water repellent finish, repelling finish, antimicrobial deodorant finish and so on) as appropriate. The cloth of the inner layer is, for example, a knitted tissue, a woven tissue, or a nonwoven fabric. The inner layer cloth may have a monolayer structure or a multilayer structure, however, a monolayer is more preferred from the view point of weight reduction. The inner layer cloth may be of synthetic fibers such as polyester, nylon or the like, or may be natural fibers. The inner layer cloth may be formed of one kind of fibers, or may be formed of combination of plural kinds of fibers. Also, original yarns (fibers) of the inner layer cloth may undergo the various finish treatments as described above.

In the present invention, the cloths of the first and the second outer layers may be made of any thread material in any sewing method without any particular limitation, and may undergo various finish treatments (for example, moisture permeable and waterproofing finish, water repellent finish, repelling finish, antimicrobial deodorant finish and so on) as appropriate. The cloths of the first and the second outer layers may be the same or different. The cloths of the first and the second outer layers are, for example, a knitted tissue, a woven tissue, or a nonwoven fabric. The cloths of the first and the second outer layers may have a monolayer structure or a multilayer structure, however, a monolayer is more preferred from the view point of weight reduction. The cloths of the first and the second outer layers may be of synthetic fibers such as polyester, nylon or the like, or may be natural fibers. The cloths of the first and the second outer layers may be formed of one kind of fibers, or may be formed of combination of plural kinds of fibers. Also, original yarns (fibers) of the cloths of the first and the second outer layers may undergo the various finish treatments as described above.

In the present invention, it is preferred that the cloth surface is rugged for providing a space part by making the layer thickness of the inner layer larger than the thickness of the inner layer cloth itself. Also, the inner layer cloth may be made of permanent-press resin fibers, or may partially contain the same to keep the rugged shape of the cloth surface.

While the cloth of the inner layer is disposed between the first outer layer and the second outer layer, it is not necessarily disposed between the first outer layer and the second outer layer, and depending on the clothing (shape of the clothing, shape of the part of the clothing, need and purpose of the part) or the bedding (shape of the bedding, shape of the part of the bedding, need and purpose of the part), the inner layer may be omitted, and there may be only the cloths of the first outer layer and the second outer layer, or there may be another cloth (or member) between the first outer layer and the second outer layer. For example, a rubber material for fitting property and for fastening, or an openable and closable fastener may be provided. As the fastener, for example, an ordinary button, a point fastener (for example, snap button), a linear fastener (for example, zipper, chuck) or a surface fastener (for example, Magictape (registered trade name)) can be recited, and these may be used singly or in appropriate combination of two or more kinds. The clothing may be provided with a pocket.

In the present invention, the cloth of the inner layer is preferably formed with heat-generated or shape-memorized crinkles. It is preferred to use the cloth formed with continuous or discontinuous crinkles or overlapping portions (crumpled texture) so that it is bulky in its thickness direction, as the inner layer. The cloth having such crinkles or crumpled texture can be obtained by a crinkling finish such as a washer finish or an embossing finish. As a new finishing method for sustaining the crinkles, it is preferred to obtain cloth by subjecting a knitted tissue, a woven tissue or a nonwoven fabric of nylon, polyester or the like to a continuous or discontinuous crinkling finish, followed by heating to shape-memorize random crinkles and shrinkage formed by the crinkling finish to realize a three-dimensional shape. The cloth realizing the three-dimensional shape with crinkles may be used by a monolayer as the inner layer, or by a laminate of two or more layers as the inner layer. Cloths of different kinds, such as a combination of cloth having small bulkiness and cloth having large bulkiness may be laminated and used as the inner layer while a space part is formed.

Further, in the present invention, the inner layer has one sheet of cloth having one kind or plural kinds of three-dimensional-shaped surfaces. The inner layer is preferably formed from one sheet of cloth having one kind or plural kinds of three-dimensional-shaped surfaces. By having different three-dimensional-shaped surfaces depending on the part of the clothing, it is possible to form the inner layer suited for the shape or the like of the clothing. As the three-dimensional shape, for example, a wave shape, a bumpy shape and the like are recited. Also a three-dimensional shape may be formed by raising a nap on the cloth surface or sewing other cloth together, however, it is more preferred to make the cloth itself have a three-dimensional shape in the aspects of light weight, compactness, low cost and so on. For making one sheet of cloth to have a three-dimensional shape, cloth containing a wave form or a bumpy shape may be knitted (for example, locally bumpy shapes are formed in plural sites by circular knitting) or woven. Also, the planar cloth may undergo bumps, a wave form, an accordion form made up of repetition of a mountain fold and a valley fold, a cylindrical shape, a semi-cylindrical shape and the like three-dimensional finish. One sheet of cloth may be formed from one kind of knitting or weaving, and one sheet of cloth may be formed by combination of plural kinds of knitting or weaving, and plural cloths may be sewed together to form one sheet of cloth. Thickness of one sheet of cloth is, for example, in the range of 0.01 mm to 1.5 mm, preferably in the range of 0.01 mm to 1.0 mm, and more preferably, in the range of 0.01 mm to 0.5 mm. Smaller thickness is preferred because the weight is reduced.

As one embodiment of the present invention, the inner layer is formed from plural cloths that are arranged in layers bulkily. Two or more sheets, rather than one sheet of cloths are laminated to form the inner layer, and each cloth has a three-dimensional-shaped surface, and is able to form a bulky and huge space layer. All of the laminated cloths may have the identical three-dimensional-shaped surfaces or may have different three-dimensional-shaped surfaces. The laminated cloths may not be stitched in the part other than an end part, or may be partially stitched. Moreover, the cloths may be intervened by planar cloth entirely or partially, and the planar cloth may be partially sewed up to the cloth.

In the above invention, in an end part of the clothing, it is preferred to sew an end part of the cloth of the inner layer together with the first outer layer and/or the second outer layer. It makes it possible to improve the compactness in the folded state while ensuring heat retention by forming the space part over a wide range. By eliminating kilting or partial sewing (sewing between the inner layer cloth and the outer layer cloth) as much as possible, coarse texture in wearing of the clothing is prevented, and the feeling of the wearing can be made comfortable. An end part of the clothing is, for example, the area around collar, the part around shoulder (upper arm), the part around waist, a fastener part and so on, in the case of a vest.

In the present invention, the cloth of the inner layer preferably has a shrinking part that is partially shrunk, and a part that is not shrunk (non-shrinking part or a part that is not substantially shrunk) to form a three-dimensional shape. The non-shrinking part may be in a condition that it is not relatively shrunk compared with the shrinking part, and for example, the shrinking part may be a strong shrinking part that is strongly shrunk, and the non-shrinking part may be a weak shrinking part that is little shrunk. When heat-shrinkable resin is applied, for example, in a gridpattern on a cloth surface, and heated, the cloth part on which the heat-shrinkable resin is applied strongly shrinks, and other part of the cloth little shrinks, so that a three-dimensional shape can be desirably formed in one sheet of cloth. Without limited to the heat-shrinkable resin, the one, when applied on a cloth surface, strongly making the surface shrink, but little making other cloth surface shrink, may be used, for example, ultraviolet shrinkable resin may be used. The shrinking part may be formed by shrinking shape-memory resin fibers contained therein by heating, while the other part is little shrunk. The shrinking part is not limited to the grid pattern.

Instead of shrinking, the cloth surface may be formed three-dimensionally by a strong expanding part that is formed by strongly expanding a part of cloth surface, and a weak expanding part that is little expanded.

In the present invention, it is preferred that the cloth of the inner layer has a plurality of openings and is formed with a three-dimensional-shaped surface by raising the cloth end surface of the opening. The opening may be formed by making a plurality of slits in the cloth, and by drawing both ends of the cloth, the slit part is opened to form an opening, and the cloth end surface of the opening is raised. The height of this raising direction corresponds to an interval of slits, and is able to define the thickness of the space part.

Also, in the present invention, the cloth of the inner layer has a plurality of cylindrical parts disposed in the cylinder radial direction to form a three-dimensional-shaped surface. By this cylindrical parts, the cloth is made bulky and an air layer and a heat-retaining layer (material) are created. The size of the cylinder (outer diametrical dimension, cylinder axial length) is not necessarily the same for all cylinders, and the size may be varied depending on the shape of the clothing, and the disposing position. The cylindrical parts may be formed at intervals rather than being formed continuously.

Also in the above invention, the cloth having the three-dimensional-shaped surface of the inner layer has a plurality of semi-cylindrical parts (semi-circular, parabolic in the cross section) disposed in the semi-cylinder radial direction, and a semi-circular opening of the semi-cylindrical parts is connected with other cloth (base cloth).

By these semi-cylindrical parts, the cloth is made bulky, and an air layer, and a heat-retaining layer (material) are created. The size of the semi-cylinder (outer diametrical dimension, cylinder axial length) is not necessarily the same for all semi-cylinders, and the size may be varied depending on the shape of the clothing, and the disposing position. The semi-cylindrical parts may be formed at intervals rather than being formed continuously.

DETAILED DESCRIPTION OF THE PREFERRED EMBODIMENTS

Example of Clothing

In the following, description will be made while taking a vest as an example of the clothing of the present invention, however, the same applies also to other clothing without limited to this.

First Embodiment

Figure 1:
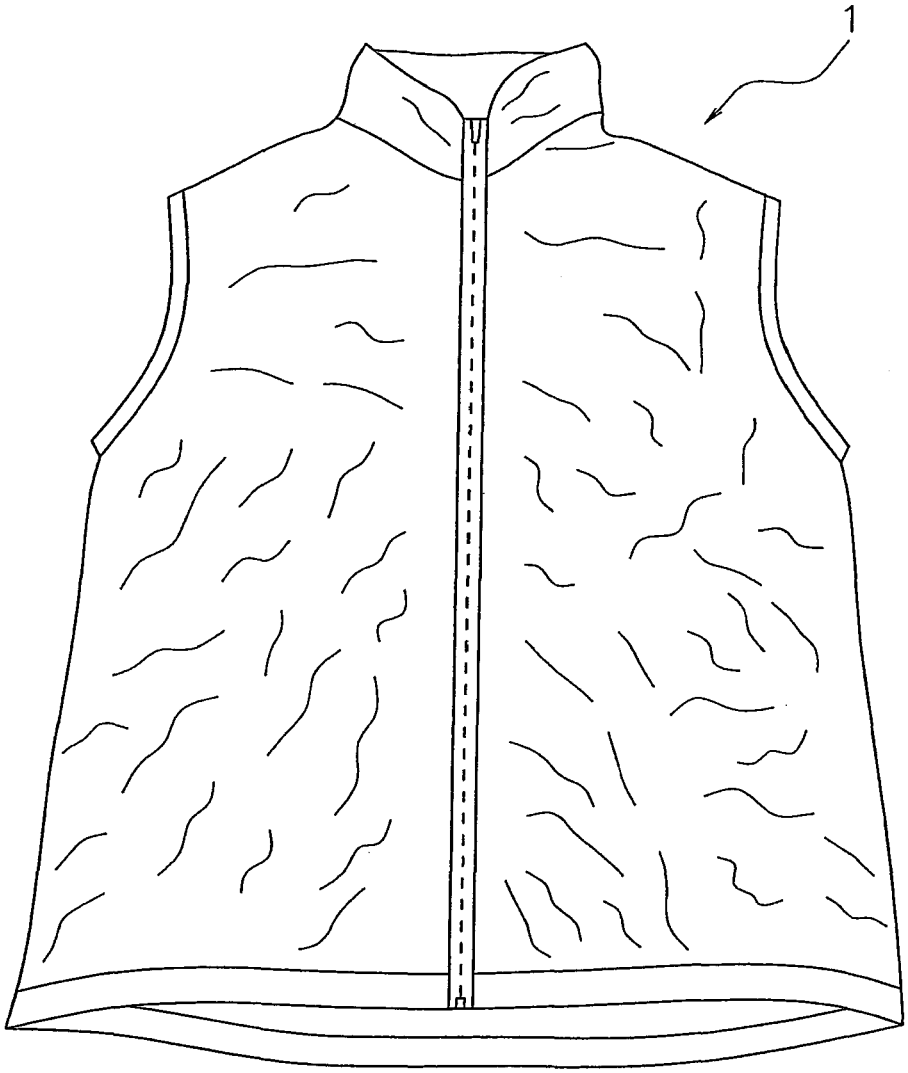
FIG. 1 is a view showing the overall appearance of a vest (clothing)
Figure 2:
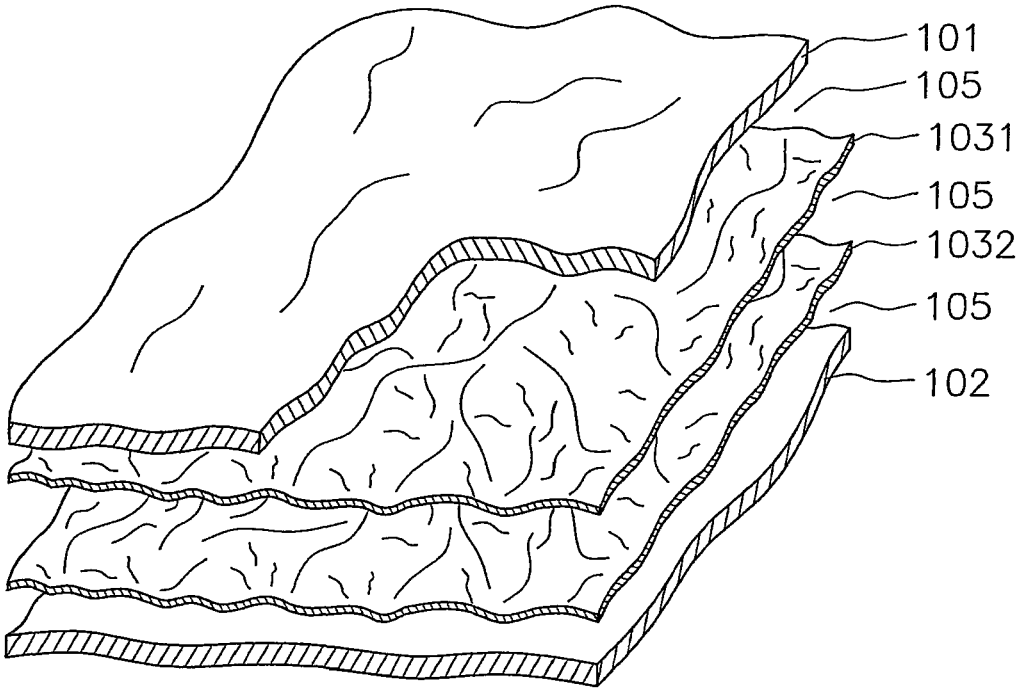
FIG. 2 is a sectional view for illustrating a first outer layer, a second outer layer and an inner layer constituting a vest (a structure of a laminate) of the first embodiment.

A vest in FIG. 1 is a heat-retaining vest having a triple-layer cloth structure. FIG. 2 schematically shows a cross section of each layer of the vest in FIG. 1. A first outer layer 101 on the skin side and a second outer layer 102 on the superficial side are of the identical nylon cloths. An inner layer which is polyester cloth (first cloth 1031, second cloth 1032) is disposed between the first outer layer 101 and the second outer layer 102 to form a space part 105 (formed between neighboring cloths). In this manner, by formation of the space part 15 between each cloth, excellent heat retention is realized. Although the inner layer is formed from two cloths of the first cloth 1031 and the second cloth 1032, the compactness in the folded state is excellent because the cloth itself is small in thickness and light in weight. Further, the first and the second outer layers, and the inner layer (first cloth 1031 and second cloth 1032) are light as a whole, and excellent in drying characteristics, and desirably keep the heat retention even when they are wet.

Figure 3:
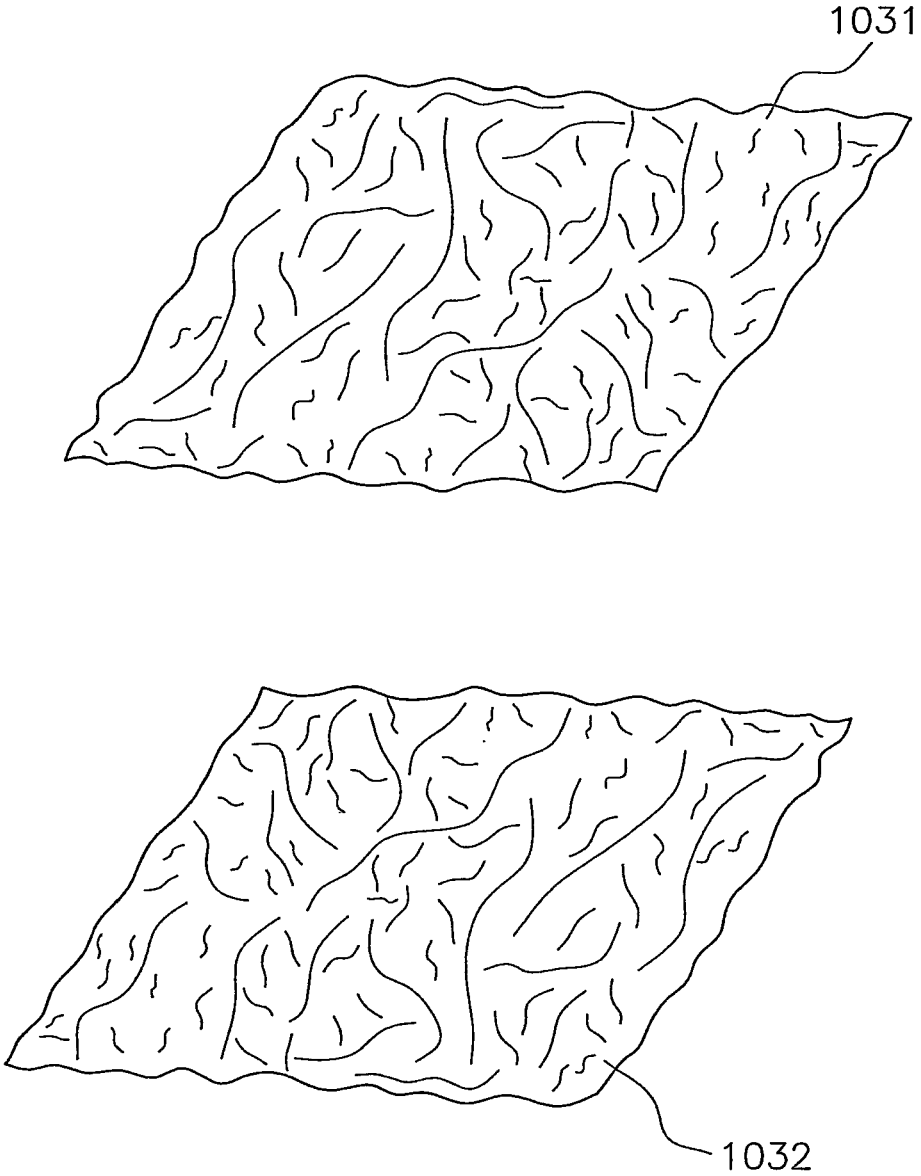
FIG. 3 is a view for illustrating one example of inner layer cloth of the first embodiment.

The first cloth 1031 and the second cloth 1032 of the inner layer shown in FIG. 3 are formed with heat-generated or shape-memorized crinkles. The first cloth 1031 and the second cloth 1032 are formed by subjecting polyester cloth to continuous or discontinuous crinkling finish, followed by heating to shape-memorize random crinkles and shrinkage formed by the crinkling finish to form a three-dimensional shape. Therefore, the shape retention is very excellent, and the crinkle shape can be retained for a long time. The first cloth 1031 and the second cloth 1032 are identical crinkled cloths. As another example, the crinkles are formed so that the first cloth 1031 is bulkier than the second cloth 1032. The space part 105 may be formed largely by combining cloth having large bulkiness and cloth having small bulkiness.

In the first embodiment, the inner layer is formed from two sheets of cloth, however, the inner layer may be formed from one sheet of cloth, or three or more sheets of cloth without limited to this. Further, the inner layer may be basically formed from one sheet of cloth, and only a specific part (for example, sleeve part, shoulder part, collar part) may be formed from two or three or more sheets of cloth.

The vest in FIG. 1 realizes excellent heat retention and wearing comfort by sewing the cloths of the first and the second outer layers 101, 102 and the cloths of the inner layer (first cloth 1031, second cloth 1032) together around shoulder (upper arm), around waist, and in a front fastener part, to reduce the sewed parts as much as possible and continuously form the space part 105 over a wide range.

Second Embodiment

Figure 4:
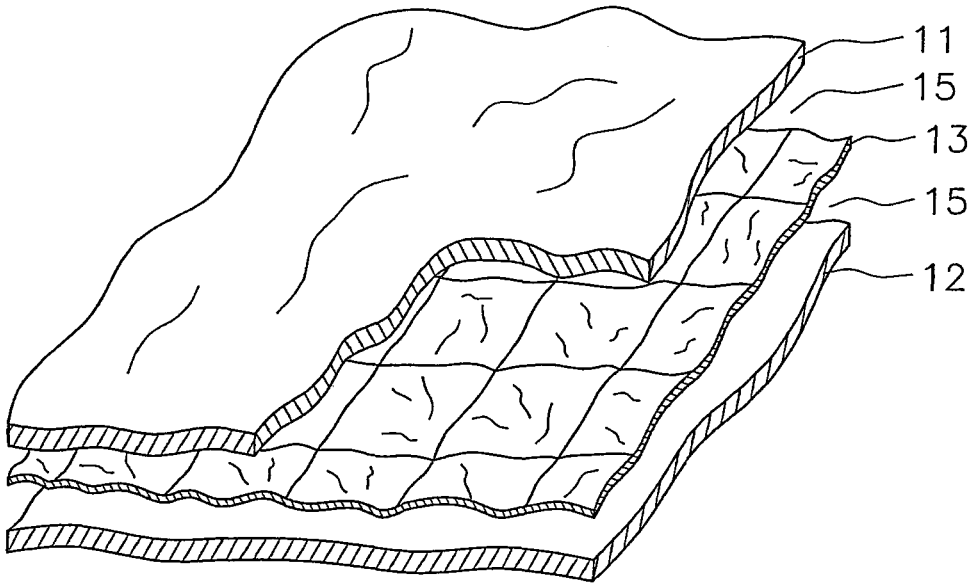
FIG. 4 is a sectional view for illustrating a first outer layer, a second outer layer and an inner layer constituting a vest (a structure of a laminate) of the second embodiment.

A vest in the second embodiment is as same as that of the first embodiment (FIG. 1), but is different in configuration of each layer. FIG. 4 schematically shows a cross section of each layer. A first outer layer 11 on the skin side and a second outer layer 12 on the superficial side are of the identical nylon cloths. An inner layer (cloth) 13 which is polyester cloth is disposed between the first outer layer 11 and the second outer layer 12 to form a space part 15. By forming this space part 15, the heat retention is excellent, and by implementing the inner layer 13 by one sheet of cloth, compactness in the folded state is excellent. Further, since each of the three layers, namely, the first and the second outer layers and the inner layer of the third layer is formed from one sheet of cloth, light weight, and excellent drying characteristics are realized, and the heat retention can be kept even when they are wet.

Figure 5:
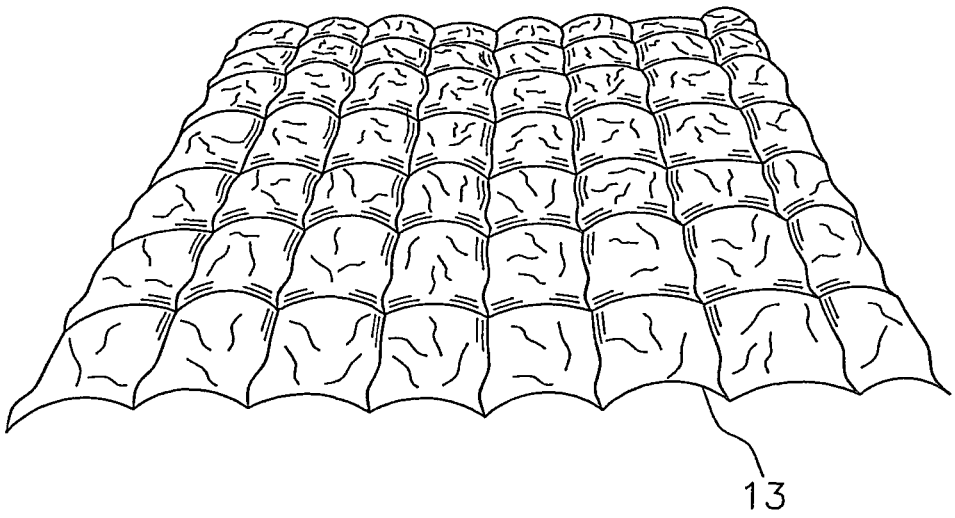
FIG. 5 is a view for illustrating one example of inner layer cloth of the second embodiment.

The inner layer 13 shown in FIG. 5 forms a three-dimensional-shaped cloth surface by having a strong shrinking part and a weak shrinking part in one sheet of cloth. As a method of forming the same, first, heat-shrinkable resin is applied (for example, printed) on the cloth surface in a grid pattern. Then the applied heat-shrinkable resin is heated by a drier, heater or the like. By this heating, the cloth part on which the heat-shrinkable resin is applied strongly shrinks and the other cloth part little shrinks, so that a three-dimensional shape can be formed in one sheet of cloth as shown in FIG. 5. In this case, it is necessary to devise the finish so that air permeability and moisture permeability will not be impaired, by means of the resin finish and the cloth density. As one example, when there is no aeration, the cloth may be continuously pierced with slits or holes to ensure the air permeability.

In the vest in FIG. 1, in the part around shoulder (upper arm), the part around waist and the front fastener, the cloths of the first and the second outer layers and the cloth of the inner layer 13 are sewed together to reduce the sewed parts of the inner layer 13 as much as possible, and the space part 15 is continuously formed over a wide range to realize excellent heat retention and wearing comfort.

Other Embodiments

Figure 6:
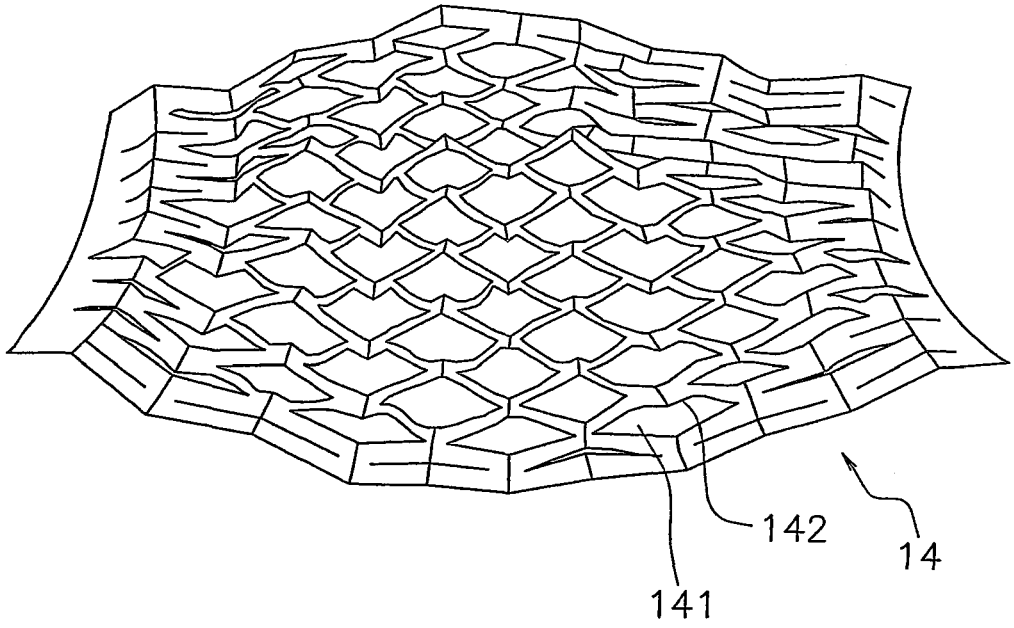
FIG. 6 is a view for illustrating another example of inner layer cloth.
Figure 7:
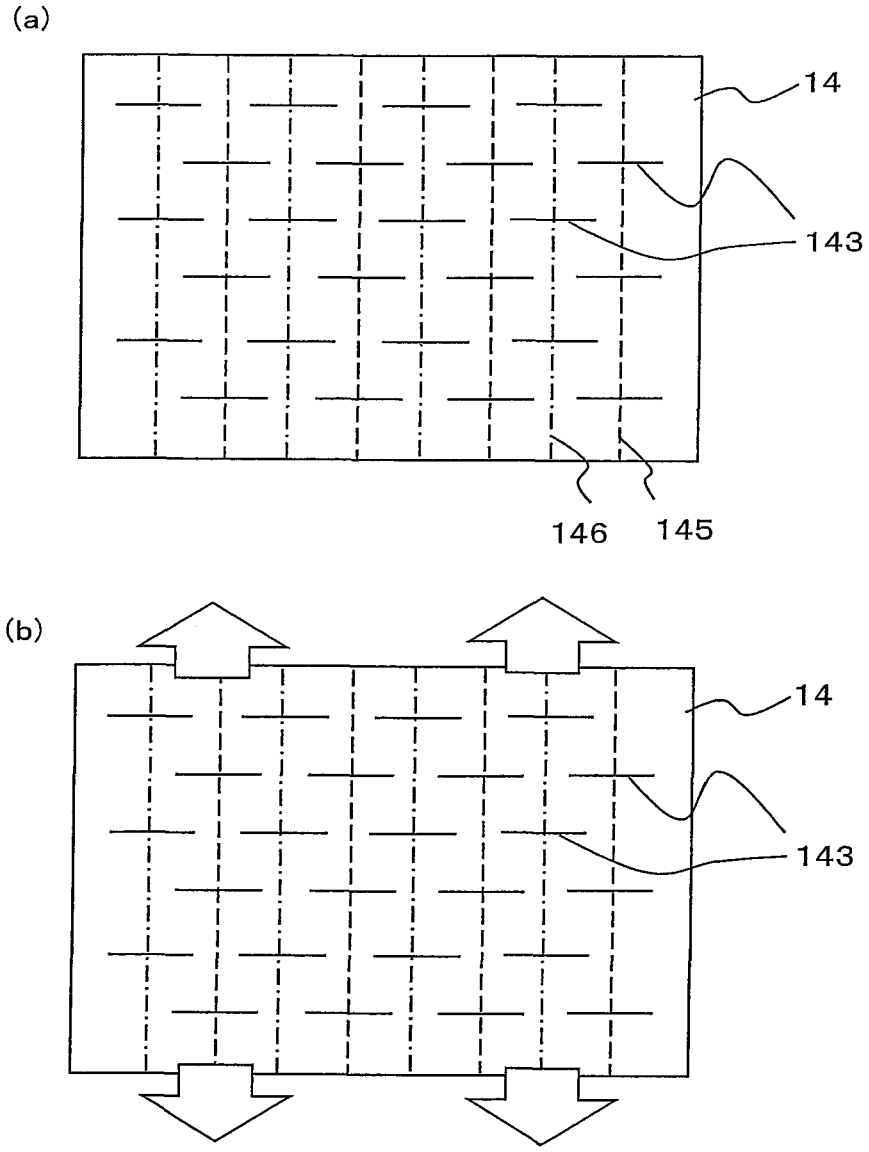
FIG. 7 is a view for illustrating a method of forming a three-dimensional shape of the inner layer of FIG. 6.

Next, an inner layer (cloth) 14 of another embodiment will be described with reference to FIG. 6. The inner layer 14 shown in FIG. 6 has a plurality of openings 141, and by raising a cloth end surface 142 of the opening 141, a three-dimensional-shaped cloth surface is formed. FIG. 7 shows a method of forming the openings. As shown in FIG. 7(*a*), in the cloth 14 formed with a mountain fold (broken line) 145 and a valley fold (dashed line) 146, plural lines of slits 143 are formed alternately in different levels. The slit 143 is formed to be perpendicular to the line of the mountain fold (broken line) 145 or the valley fold (dashed line) 146. As shown in FIG. 7(*b*), both end parts of the cloth (upper and lower ends in FIG. 7) are drawn in the direction perpendicular to the slit 143 (line) to make each slit open to form the opening 141 as shown in FIG. 6. By alternate repetition of the mountain fold and the valley fold, the opening 141 is formed and the cloth end surface 142 is raised at the position of the slit 143. The interval of lines of the slits 143 (interval between the lines in the vertical direction in FIG. 7) defines the thickness of the space part 15.

Figure 8:
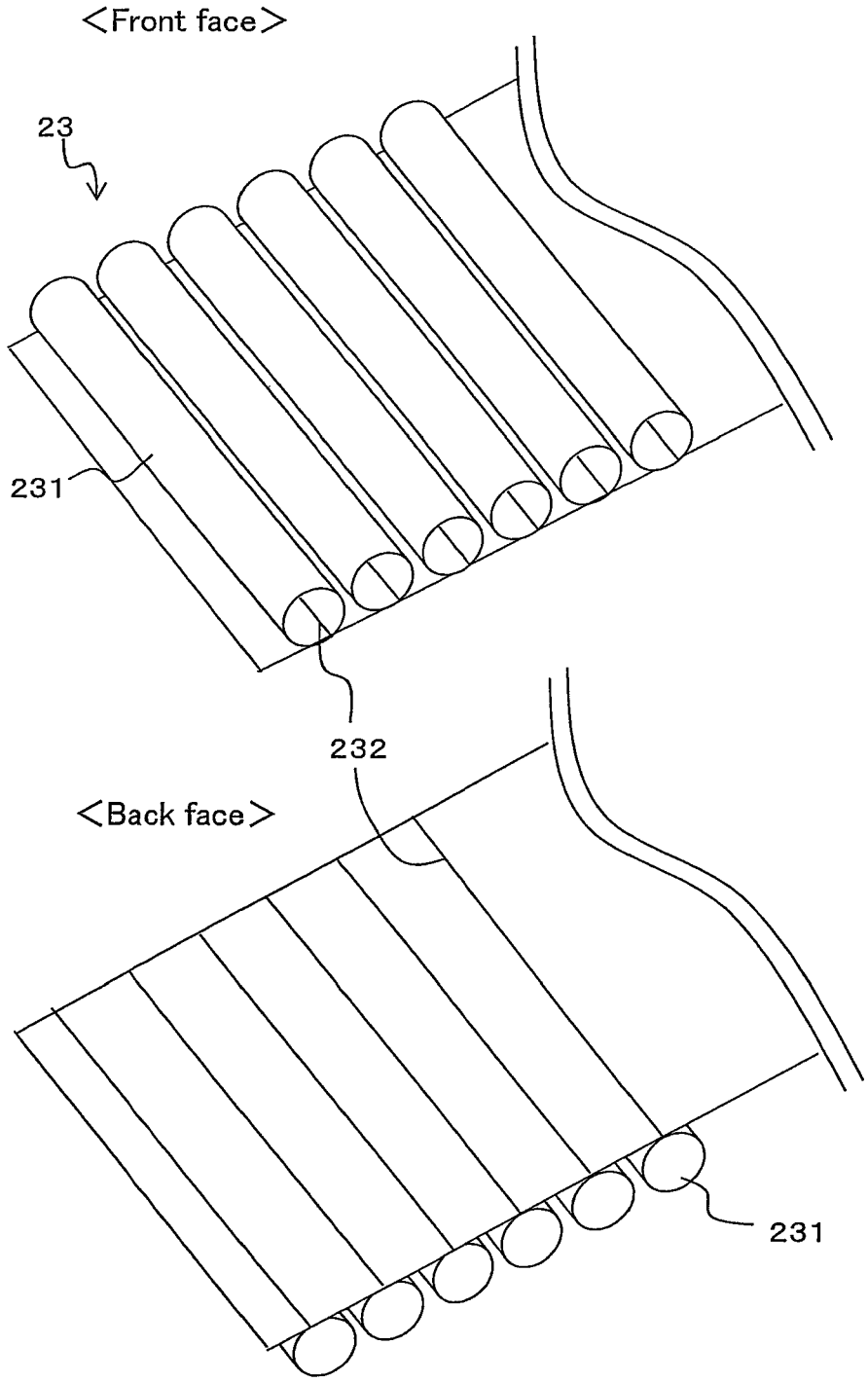
FIG. 8 is a view for illustrating another example of inner layer cloth.
Figure 9:
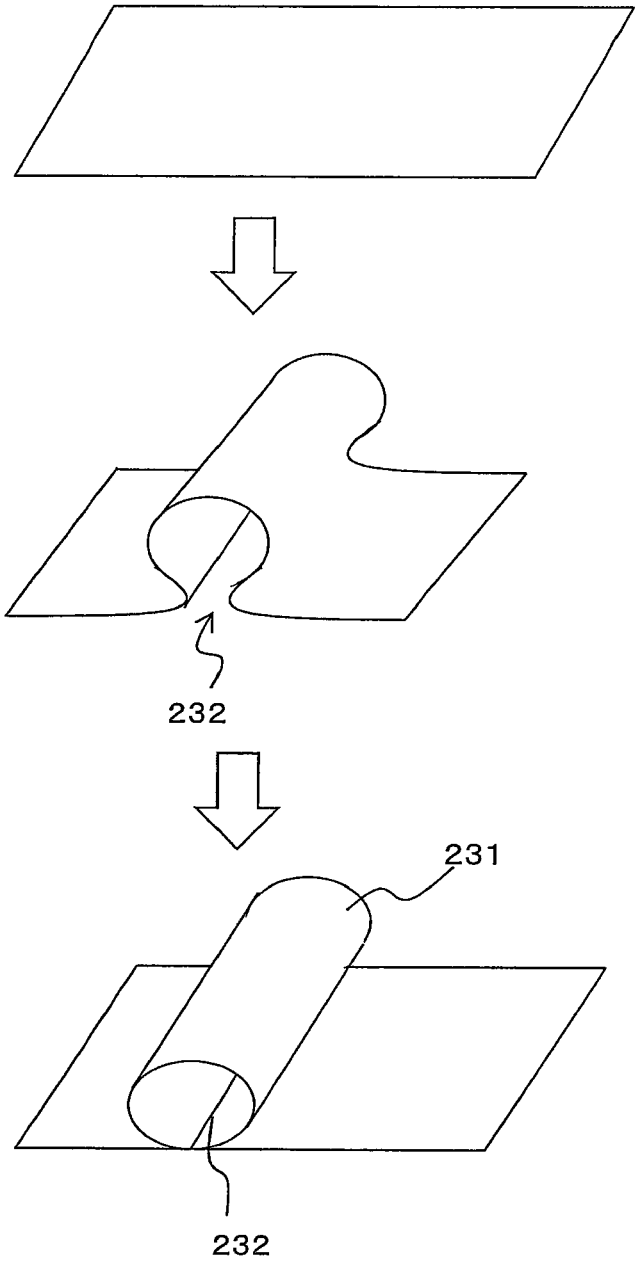
FIG. 9 is a view for illustrating a method of forming a cylindrical part of the inner layer of FIG. 8.

Next, an inner layer (cloth) 23 of still another embodiment will be described by using FIG. 8. The cloth 23 of the inner layer shown in FIG. 8 forms a three-dimensional shape by having a plurality of cylindrical parts 231 arranged parallel in the cylinder radial direction. FIG. 9 shows a method of forming a cylindrical part. As shown in FIG. 9, cylindrical parts 231 are continuously formed from one sheet of cloth, and a cylinder abutting part 232 is joined by sewing, welding (high frequency welder), laser process, or with an adhesive. According to this method, it is possible to form the cylindrical part 232 in each of the vertical direction and horizontal direction for the original whole cloth. The size of the cylinder (outer diametrical dimension, cylindrical axial length) may not be necessarily the same for all cylinders, and the size may be varied depending on the shape of the clothing and the disposing part. The cylinder may be formed at intervals rather than being formed continuously. Also, when it is disposed in both outer layers, an air layer is desirably formed even when there is a recess in the cylinder.

Figure 10:
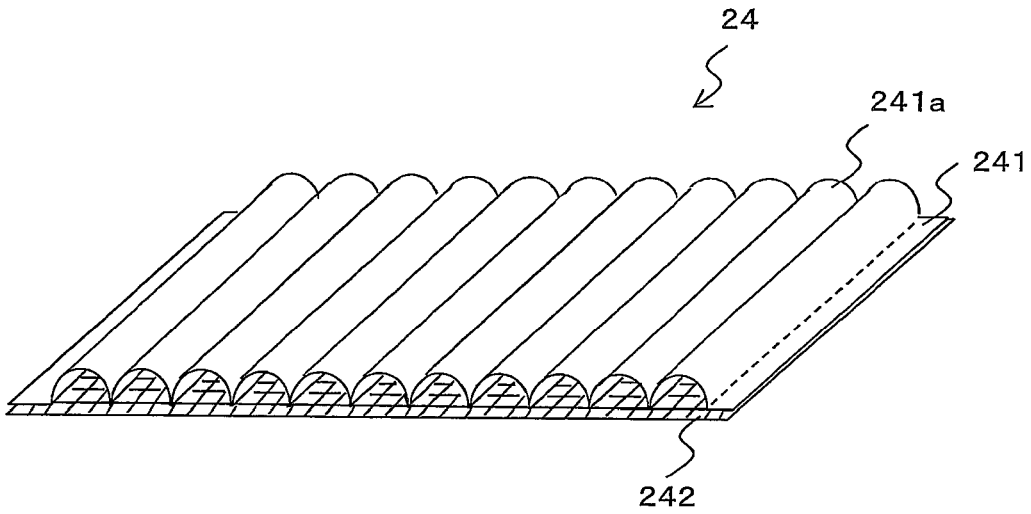
FIG. 10 is a view for illustrating another example of inner layer cloth.
Figure 11:
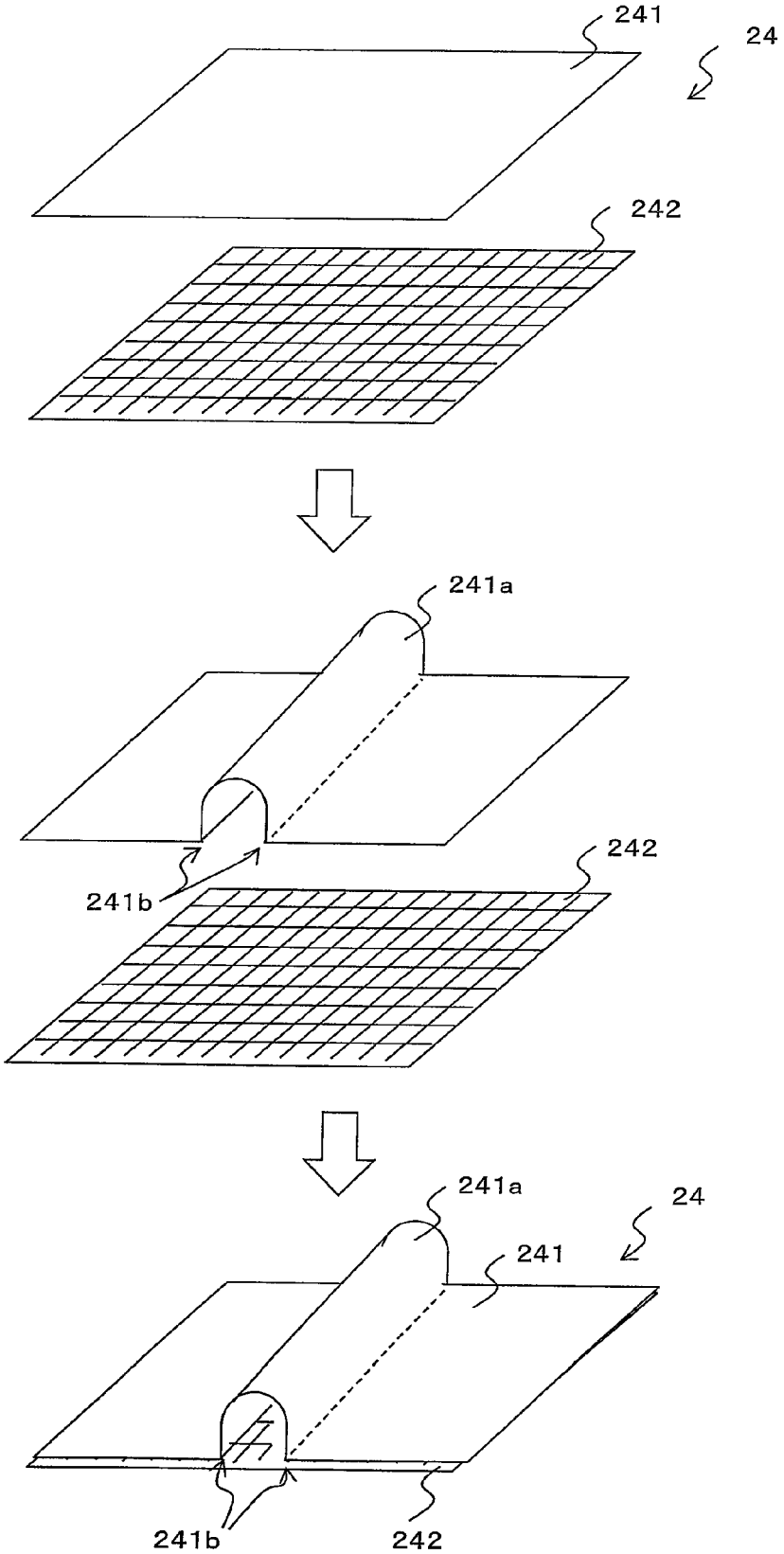
FIG. 11 is a view for illustrating a method of forming a semi-cylindrical part of the inner layer of FIG. 10.

Next, an inner layer (cloth) 24 of a further embodiment will be described by using FIGS. 10 and 11. In the inner layer 24 shown in FIG. 10, cloth 241 having a three-dimensional-shaped surface of the inner layer 24 has a plurality of semi-cylindrical parts 241*a* (semi-cylindrical, parabolic in cross section) arranged parallel in the semi-cylinder radial direction, and a semi-circular opening (fold part) 241*b* of the semi-cylindrical parts 241*a* is connected with separate base cloth 242. As the base cloth 242, cloths of light weight (woven fabric, knitted fabric, tricot, nonwoven fabric and so on) are exemplified. FIG. 11 shows a method of forming the semi-cylindrical parts 241*a*. As shown in FIG. 11, the semi-cylindrical parts 241*a* are continuously formed from one sheet of cloth, and the semi-circular opening (fold part) 241*b* and the base cloth 242 are joined by sewing, welding (high frequency welder), laser process, or with an adhesive. According to this method, it is possible to form the semi-cylindrical part 241*a* in each of the vertical direction and horizontal direction for the original whole cloth. The size of the semi-cylinder (outer diametrical dimension, cylindrical axial length) may not be necessarily the same for all semi-cylinders, and the size may be varied depending on the shape of the clothing and the disposing part. The semi-cylinders may be formed at intervals rather than being formed continuously. When it is arranged in both outer layers, an air layer is desirably formed even when there is a recess in the semi-cylinder. The base cloth 242 may be one or more sheet of cloth, and may be a burred knitted tissue or woven tissue. The base cloth may be a tape-like cloth in the form of a grid. The base cloth may be a plastic film, and the plastic film may have a plurality of openings such as in the form of a grid from the view point of air permeability.

The various three-dimensional shapes of inner layer cloth are not limited to such a shape that one kind of three-dimensional shape is arranged continuously in parallel, and, for example, it may be arranged continuously in an inverted-V shape. When the inner layer is formed from one sheet of cloth, cloths having three-dimensional-shaped surface may be combined (for example, sewed) in the end parts to form one large sheet of cloth. When the inner layer is formed from plural sheets of cloths arranged bulkily in layers, a double layer may be formed by folding large cloth, or separate cloths may be stacked, for example.

The clothing is not limited to a vest, and may be clothing for upper body, clothing for head, neck, clothing for lower body, clothing for foot, clothing for part of body, seat, glove, socks, muffler and so on. Also, the aforementioned vest or the clothing of the present invention may be formed with a pocket. Furthermore, the aforementioned vest or the clothing of the present invention may be formed with a fastener part, but the fastener part may not be provided.

In the aforementioned vest, less stitching between the inner layer 13 and the first and the second outer layers 11, 12 is preferred, however, they may be stitched as is necessary.

Each of the cloths 13, 14, 23, 24 of the inner layer may be formed as a monolayer structure, however, the inner layer may be formed by a laminate structure of plural layers. The combination of cloths that are laminated is free.

The inner layer may be formed from one sheet of cloth having a different three-dimensional-shaped surface depending on the parts of the clothing (arm part, body part, neck part, foot part, head part and so on). In this case, a plurality of different three-dimensional-shaped surfaces (bulkiness) may be formed by one sheet of cloth, or plural sheets of cloth respectively having different three-dimensional-shaped surfaces (bulkiness) may be sewed together to form one sheet of cloth.

Example of the Bedding

Description will be made while taking a sleeping bag as an example of the bedding of the present invention. The first cloth 1031 (or the second cloth 1032) shown in FIG. 3 is used. This first cloth 1031 and a lining cloth of the sleeping bag (the first outer layer) are placed one on top of the other and are sewed together to a bag-like shape (sewed so that a space part is formed). Subsequently, it is inserted into an outer cloth (the second outer layer) formed into a bag-like shape beforehand, and the outer cloth and the lining cloth are partially bonded or sewed to each other to form a sleeping bag. Examples of a structure of the laminate of cloths composing a sleeping bag, include a laminate structure of FIGS. 2 and 3. Examples of the inner layer cloth include FIGS. 3, 5, 6, 8, and 10.

When the laminate of cloths of the present invention is used as bedding, it is preferred to adjust the laminating number of an inner layer depending on the intended use, the region (dorsal side, ventral side, shoulder, belly, hip, leg, foot and the like), or the service temperature range.

The laminate of cloths of the present invention is not limited to a sleeping bag, and is also preferably used for other bedding.

What is claimed is:

1. Laminate of cloths having a first outer layer, a second outer layer, and an inner layer disposed between the first outer layer and the second outer layer, wherein a layer thickness of the inner layer disposed between the first outer layer and the second outer layer is formed to be larger than a cloth thickness of the inner layer, a first space part is formed between the first outer layer and the inner layer, and a second space part is formed between the second outer layer and the inner layer;

wherein a cloth of the inner layer is selected from the group consisting of a knitted tissue, a woven tissue, and a nonwoven fabric, and a thickness of the cloth is in the range of 0.01 mm to 1.5 mm; and wherein the inner layer is formed by subjecting the cloth to continuous or discontinuous crinkling finish, followed by heating to shape-memorize random crinkles oriented in random directions and shrinkage formed by the crinkling finish to form a three-dimensional shape so that it is bulky in thickness direction of the cloth.

2. The laminate according to claim 1, wherein the cloth of the inner layer is formed from one sheet of cloth or is formed from plural cloths into a bulky layered form.

3. The laminate according to claim 1, wherein in an end part of the laminate, an end part of cloth of the inner layer is sewed with the first outer layer and/or the second outer layer.

4. Clothing comprising laminate of cloths according to claim 1.

5. Bedding comprising laminate of cloths according to claim 1.

6. The laminate according to claim 1, wherein the laminate is compacted in the folded state and the space part is formed in the unfolded state.

7. Laminate of cloths having a first outer layer, a second outer layer, and a first and second inner layer disposed between the first outer layer and the second outer layer, wherein a layer thickness of the inner layer disposed between the first outer layer and the second outer layer is formed to be larger than a cloth thickness of the first and second inner layer, a first space part is formed between the first outer layer and the first inner layer, a second space part is formed between the second outer layer and the second inner layer, and a third space part is formed between the first inner layer and the second inner layer;

wherein a cloth of the first and second inner layer is selected from the group consisting of a knitted tissue, a woven tissue, and a nonwoven fabric, and a thickness of the cloth is in the range of 0.01 mm to 1.5 mm;

wherein the first and second inner layer are formed by subjecting the cloth to continuous or discontinuous crinkling finish, followed by heating to shape-memorize random crinkles oriented in random directions and shrinkage formed by the crinkling finish to form a three-dimensional shape so that it is bulky in thickness direction of the cloth.

8. The laminate according to claim 7, wherein in an end part of the laminate, an end part of cloth of the first and second inner layer are sewed with the first outer layer and/or the second outer layer.

9. The laminate according to claim 7, wherein the laminate is compacted in the folded state and the first, second and third space part are formed in the unfolded state.

10. Clothing comprising laminate of cloths according to claim claim 7.

11. Bedding comprising laminate of cloths according to claim claim 7.

* * * * *